US007850485B2

(12) United States Patent
Bartholoma et al.

(10) Patent No.: US 7,850,485 B2
(45) Date of Patent: Dec. 14, 2010

(54) PLUG CONNECTOR FOR FRONT PLATE OR BACK PLATE ASSEMBLY

(75) Inventors: Mario Bartholoma, Winden (DE); Fritz Zugel, Waldkirch (DE); Volker Gotz, Kenzingen (DE); Philipp Gerber, Gutach (DE); Gunter Reich, Elzach (DE)

(73) Assignee: Anton Hummel Verwaltungs - GmbH, Waldkirch (DE)

( * ) Notice: Subject to any disclaimer, the term of this patent is extended or adjusted under 35 U.S.C. 154(b) by 0 days.

(21) Appl. No.: 12/447,679

(22) PCT Filed: Nov. 17, 2007

(86) PCT No.: PCT/EP2007/009955

§ 371 (c)(1),
(2), (4) Date: Apr. 29, 2009

(87) PCT Pub. No.: WO2008/064786

PCT Pub. Date: Jun. 5, 2008

(65) Prior Publication Data

US 2010/0003850 A1 Jan. 7, 2010

(30) Foreign Application Priority Data

Nov. 29, 2006 (DE) ..... 20 2006 018 110 U

(51) Int. Cl.
*H01R 13/73* (2006.01)

(52) U.S. Cl. ..... 439/550

(58) Field of Classification Search ..... 439/550, 439/563, 551, 544, 797, 562, 564; 248/74.5
See application file for complete search history.

(56) References Cited

U.S. PATENT DOCUMENTS

| | | | | |
|---|---|---|---|---|
| 5,066,247 | A | 11/1991 | Watson | |
| 5,302,138 | A * | 4/1994 | Shields | 439/527 |
| 5,419,665 | A | 5/1995 | Adams et al. | |
| 5,893,777 | A * | 4/1999 | Kantor | 439/550 |
| 6,231,380 | B1 * | 5/2001 | Cabalka et al. | 439/540.1 |
| 6,666,145 | B1 * | 12/2003 | Nardone et al. | 102/489 |
| 6,840,782 | B1 * | 1/2005 | Borden et al. | 439/92 |
| 2002/0025718 | A1 | 2/2002 | Cabalka et al. | |
| 2002/0185327 | A1 | 12/2002 | Morykon et al. | |

FOREIGN PATENT DOCUMENTS

| | | |
|---|---|---|
| DE | 1790065 | 12/1971 |
| DE | 10019319 | 10/2001 |
| EP | 0893852 | 1/1999 |

* cited by examiner

*Primary Examiner*—T C Patel
*Assistant Examiner*—Phuong Nguyen
(74) *Attorney, Agent, or Firm*—Volpe and Koenig, P.C.

(57) ABSTRACT

A plug connector having a housing located at a plate opening in an operating position, and the plug connector contains wires and/or braids of a cable and electrical contacts. Assembly on the plate is realized by a flange plate attached to the outside of the housing having an interior recess with an interior dimension for engaging the housing of the plug connector. The flange plate is constructed as a single piece, and one of the interior recesses has a continuous slot extending to the outside, which slot acts as a clamp slot with the interior dimension of the interior recess being made smaller by narrowing the slot, and an arrangement is provided, by which the flange plate can be pressed in and thus clamped onto the outside of the housing. Preferably, the slot is reduced by at least one clamp screw with locking threads, or a lock nut.

9 Claims, 5 Drawing Sheets

Fig. 2
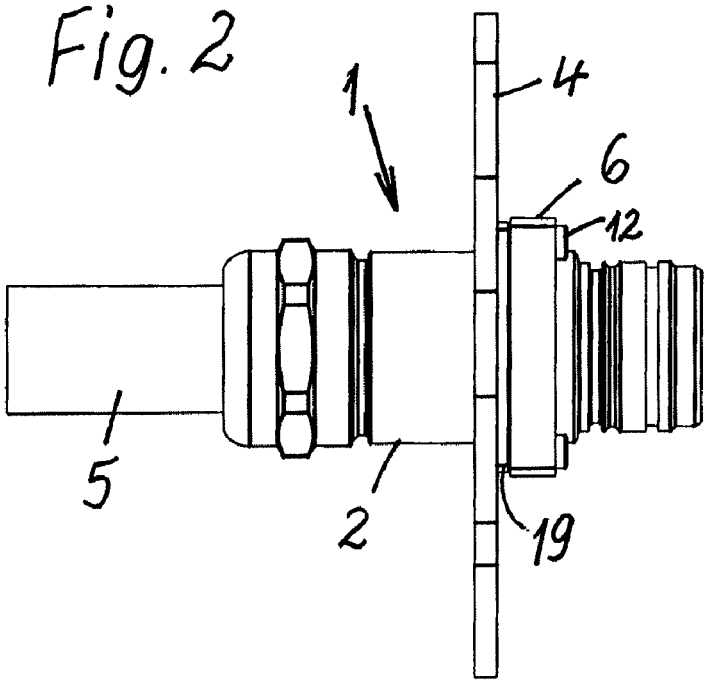
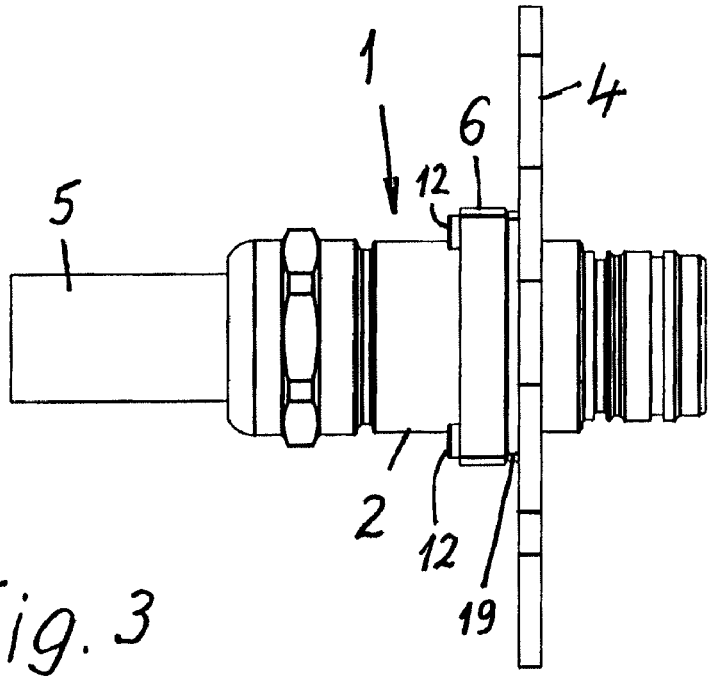
Fig. 3

PLUG CONNECTOR FOR FRONT PLATE OR BACK PLATE ASSEMBLY

BACKGROUND

The invention relates to a plug connector that is arranged, in its position of use, with its housing in or on an opening in a plate or passes through this opening and contains wires and/or braids of a cable and electrical contacts, wherein the plug connector can be mounted, for a front-plate assembly or back-plate assembly, in the region of the opening of the plate, in particular, detachably via a flange, and the flange is formed as a flange plate that can be engaged at a later time onto the outside of the housing of the plug connector and that has an inner recess with an inner periphery for gripping around the housing of the plug connector.

Such a plug connector is known from DE 100 19 319 A1. The flange plate is here formed with multiple parts or at least two parts, in order to be able to equip the housing of the plug connector at a later time so that front-plate assembly or back-plate assembly is also possible selectively. In addition, in this way such a plug connector or a coupling part of an electrical plug can also be provided without a flange plate and can be provided at a later time if necessary.

Here, the two parts of the flange plate must be machined very precisely so that, after they are joined, they hold the outside of the plug connector housing with a non-positive fit, without the flange plate being able to be shifted on the outside of the housing, wherein, however, a pressure that is not too large should be applied to the outside of the housing. Therefore, in this previously known arrangement a clamping screw oriented in the radial direction was provided and also tightened on each of the two halves of the flange plate, without allowing the later connection of the two halves of the flange plate to become detached. Consequently, the form locking engagement for connecting the two parts of the flange plate is complicated.

SUMMARY

Thus there arises the objective of creating a plug connector or a plug connector half of the type mentioned above, wherein a flange plate that can be positioned at a later time can be easily produced and easily brought into a non-positive fit connection with the outside of the housing of the plug connector and should realize as much contact across the entire inner periphery of the inner recess as possible, so that there is good transmission of the holding forces.

For meeting this objective, it is provided that the flange plate is formed with one part and has a slot or break running continuously outward from its inner recess and that the inner periphery of the inner recess of the flange plate can be reduced through the narrowing of the slot or the break and that means are provided with which the flange plate can be mounted on the outside of the housing of the plug connector through the decrease in its inner periphery.

In this way the need is avoided to form the flange plate in two parts and nevertheless to then have to connect their parts tightly to each other so that they can withstand the forces of clamping screws and attachment screws. Due to the slot or break, the flange plate initially can have an oversized inner periphery and thus can be pushed, for example, in the axial direction also over smaller projections onto the outside of the plug connector housing. Then the inner periphery can be reduced through the reduction of the slot or the break and thus the flange plate can be clamped tight onto the outside of the housing, without requiring clamping screws that are oriented in the radial direction and that act on the outside of the plug connector housing. Here it is also advantageous that the clamping force with which the one-part flange plate attaches to the outside of the housing of the plug connector can be transmitted essentially automatically and uniformly on the periphery and can be adapted practically continuously to the corresponding force requirements, in that the force expended in the reduction of the slot or the break can be tuned to the corresponding requirements.

Here it is useful when the flange plate attaches to the outside of the housing of the plug connector with a non-positive fit in its position of use and is mounted, in particular, detachably. It is also useful when the means for reducing the slot or the break can also be activated in the opposite direction for detaching.

Here, a preferred embodiment of the invention can be provided such that at least one adjustment or clamping screw oriented transverse or perpendicular to the profile of the slot or break is provided for changing a width or dimension of this slot or break, wherein this screw is arranged adjustably outside of an inner periphery and outside of the inner recess of the flange plate having this inner periphery. Thus, there is no clamping screw that acts in the radial direction on the outside of the housing, but instead, for the arrangement according to the invention, the clamping screw can be arranged outside of the actual housing and can exert its clamping effect indirectly through the reduction of the slot width. Such a clamping screw with a mating locking thread thus favorably produces one means with which the reduction of the periphery of the flange plate can be performed and this can be mounted detachably on the plug connector.

The clamping screw can be arranged on a side of the slot in a recess oriented approximately in the peripheral direction of the inner periphery or can engage in a corresponding borehole or perforation as a recess and can pass through or bridge the slot and can engage in a mating thread on the other side of the slot, especially in a preassembled manner. The abutment for this clamping screw opposite the thread can here be a screw head of this clamping screw advantageously countersunk in the recess. In practice, the opening and recess holding the clamping screw can extend parallel to a tangent on the inner periphery or on the outside of the housing of the plug connector, in order to achieve a best possible clamping effect on the slotted or broken flange plate.

It can be advantageous when a polygonal flange or square flange is provided as the flange plate whose corner regions have openings or perforations that are arranged parallel to the inner recess and that are used for attachment elements or screws and when the slot or the break is arranged in a corner region without an attachment perforation or adjacent to an attachment perforation at a position that has a greater radial dimension or width than the middle between two corner regions of the flange plate. In this way, the slot or the break of the flange plate can have a relatively large length and thus sufficient space for a screw of adequate cross section passing through the slot, without having to provide a special widening for this clamping screw on the outside of the flange plate, which, however, would also be possible or conceivable.

The slot can extend radially to the advantageously somewhat circular inner recess or to the somewhat circular inner recess or to the somewhat circular inner periphery of the flange plate and the clamping screw can be arranged parallel to a tangent to the inner periphery running through the slot. This produces a best-possible allocation of the slot or the clamping screw to the flange plate that can be contracted through the narrowing of the slot, so that there is good transmission and distribution of the clamping force applied to the clamping screw onto the inner periphery of the flange plate.

So that the flange plate according to the invention can also be shifted axially via nuts or regions that have larger cross sections or diameters than the housing of the plug connector and that are arranged, for example, at the end of the plug connector, the inner recess can exceed the outer contours of the housing of the plug connector by a region of larger diameter located on the plug connector and adjacent to the position of use and can hold an adapter ring also having a slot or a break in the position of use in its inner periphery, wherein this adapter ring is formed as an elastic ring and contacts at least one stop in the inner recess of the flange plate in the position of use in the axial direction. Thus the device can also have, in addition to the flange plate, an adapter ring that fits in the inner recess and whose cross section is reduced, if necessary, so that the clamping according to the invention with the outside of the housing of the plug connector is possible through the use of this adapter ring that, however, is first positioned in its position of use on the inner periphery of the flange plate and can be inserted there when the flange plate is pushed in the axial direction over correspondingly enlarged outer contours of the plug connector. Because this adapter ring is formed as an elastic ring and is also slotted, in the position of use, it also follows the corresponding clamping movement for the reduction and contraction of the slot or the break in the flange plate.

So that the adapter ring can be held already at its future position of use during storage and transport and its placement is simplified for assembly, an undercut whose distance from the stop is equal to or somewhat greater than an axial thickness of the adapter or spring ring can be provided parallel to the stop arranged on or in the inner opening of the flange plate for the adapter ring and the width of the slot or the break of the unloaded adapter or spring ring can be dimensioned so that this adapter ring fits over the undercut with the slot reduced by compression or with the reduced break and can be inserted axially up to the stop. Therefore, in its position of use, the spring ring reaches a holder in both axial directions, but can be inserted in this position formed to some extent as an annular groove such that it compresses somewhat and therefore its slot is reduced against the spring force, in order to be able to overcome the somewhat smaller inner periphery laterally from this annular groove or the undercut in the axial direction.

For sealing the flange plate relative to the housing plate and/or the outside of the housing of the plug connector, a seal engaging at least partially into the inner recess and the inner periphery of the flange plate can be provided that has, in the region of the inner recess, an axial ring projection or a widened section that fits into the inner recess and covers this at least across a portion of the axial dimensions or up to an adapter ring arranged in the inner opening. Thus, the flange plate can be occupied on one side across at least one portion of its surface with the seal that can be located in the position of use between the flange plate and the plate on which the plug connector is provided or through which the plug connector is guided and simultaneously the inner periphery of the flange plate can also be covered at least in some regions by this seal, in order to also achieve at this position a seal relative to the plug connector and its housing.

Here it is favorable when the seal of the flange plate engages in the flange plate in the axial direction at least approximately up to the center of the inner recess of the flange plate and at least partially or completely covers its slot or break and the surface or stop surface of the flange plate extending in the radial direction to this slot or break. Thus, the slot or the break is also sealed. In addition, the slot can also maintain a residual width that, however, is also sealed, in the reduced and contracted position.

Simultaneously, this flexible and elastic seal can deform accordingly during the contraction of the slot and can also be pressed against the outside of the plug connector.

Primarily for the combination of individual or several of the features and measures described above, a plug connector is produced with a flange plate that can be attached at a later time and that can have an essentially one-part construction and a correspondingly stable construction and nevertheless they allow, in particular, a non-positive fit connection with the outside of the plug connector at a later time.

BRIEF DESCRIPTION OF THE DRAWINGS

Below, embodiments of the invention will be described in greater detail with reference to the drawing. Shown in a partially schematic diagram are.

DETAILED DESCRIPTION OF THE PREFERRED EMBODIMENTS

Figure 9:
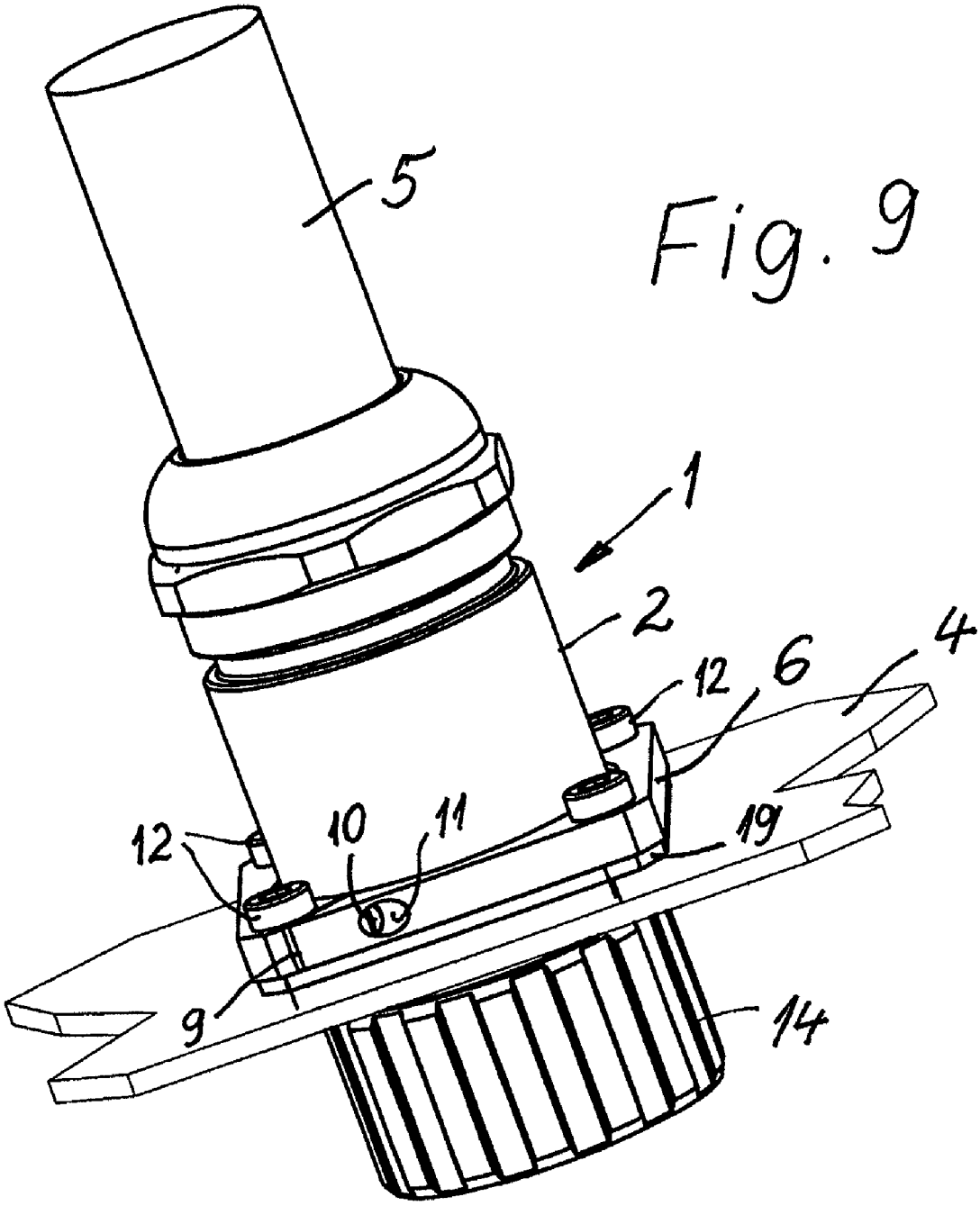

A plug connector designated as a whole with 1 is arranged in the position of use according to FIGS. 2, 3, and 9 with its housing 2 in or at an opening 3 or passing through this opening, wherein the opening 3 is provided in a plate 4 through which an electrical connection is to be guided. Typically, the plug connector 1 contains wires and/or braids of a cable 5 and electrical contacts that are not shown in more detail and that can interact with a locking piece in a corresponding plug connection.

The plug connector 1 can be mounted—in this embodiment detachably—according to FIG. 2 in a front-plate assembly and according to FIGS. 3 and 9 in back-plate assembly in the region of the opening 3 of the plate 4 by a flange designated as a whole with 6, wherein the flange 6 is formed as a flange plate that can be positioned at a later time on the outside of the housing 2 of the plug connector 1 and that is shown enlarged in two different embodiments in FIGS. 4 to 7 and has an inner recess 7 with an inner periphery for gripping around the housing 2 of the plug connector 1, which is shown in the assembled position in each of FIGS. 2, 3, and 9.

The essentially circular inner periphery is here indicated with 8 in the figures and the following description. Primarily in FIGS. 1 and 4 to 8 it can be seen that the flange 6 formed as a flange plate, also called flange plate 6 below, has a one-part construction and nevertheless can be pushed onto the outside of the housing 2 of the plug connector 1 at a later time, and the flange plate has a slot 9 or a break running continuously toward the outside from its inner recess 7 and the inner periphery 8 of the inner recess 7 of the flange plate 6 can be reduced by narrowing the slot 9 and therefore can be adapted to and pressed onto the outer periphery of the housing 2.

Here, means still to be described are provided with which the flange plate 6 can be mounted through reduction of its inner periphery 8 onto the outside of the housing 2 of the plug connector 1.

According to FIGS. 2, 3, and 9, the flange plate 6 grips with a non-positive fit onto the outside of the housing 2 of the plug connector 1 in the position of use, but is mounted detachably in a way still to be described.

For changing the opening, width, or dimensions of the slot 9 that could also be formed as a break, in the embodiment there is an adjustment or clamping screw 10 that is oriented transverse or perpendicular to the profile of this slot 9 and that is arranged adjustable outside of the inner periphery 8 and outside of the inner recess 7 of the flange plate 6 having this inner periphery 8 and whose end with an activation slot can be seen, for example, in FIGS. 1, 5, 7, 8, and 9 within a corresponding screw opening. Furthermore, one sees the section of this clamping screw 10 passing through the slot 9 in FIGS. 4 and 6.

Here, the clamping screw 10 is arranged on a side of the slot 9 in a recess 11 oriented approximately in the peripheral direction of the inner periphery 8 and passes through or bridges the slot 9 and engages in a mating thread not shown in greater detail on the other side of the slot 9, so that, by turning the clamping screw 10 that is supported with a head in the part of the recess 11 facing away from the threaded region, the slot width can be changed, as known for tubular shells or other annular bodies that can be clamped.

Figure 1:
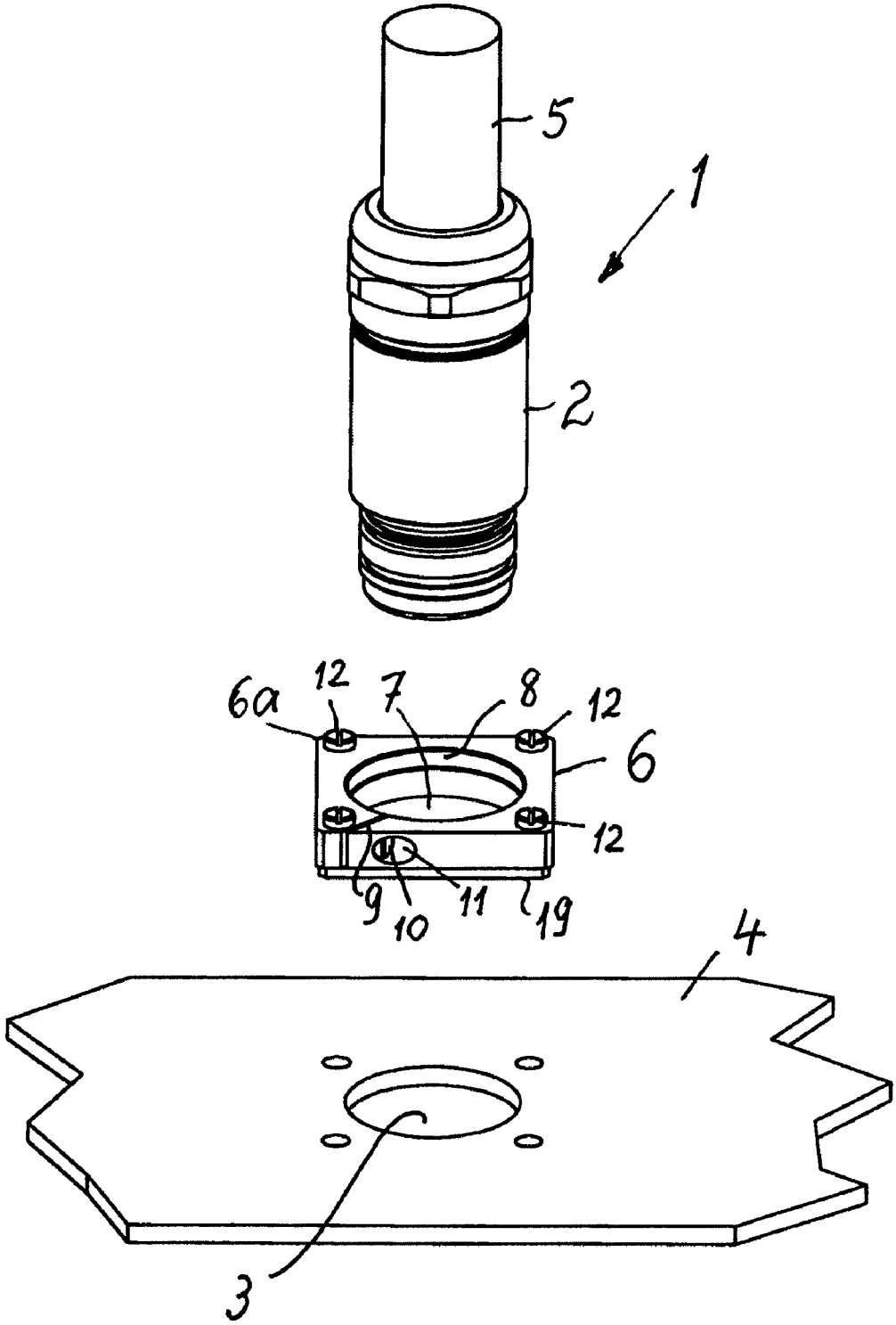
FIG. 1 in a perspective view, a pre-assembly position of a plug connector according to the invention before the slotted flange plate is pushed axially onto this plug connector, clamped, and then fixed at the perforation in the housing plate, FIG. 2 in side view, a plug connector according to the invention in assembled position, wherein a front-plate assembly is shown, FIG. 3 a view corresponding to FIG. 2 with a back-plate assembly of the plug connector, FIG. 4 a top view of an embodiment of the flange plate according to the invention with a slot arranged according to the invention, FIG. 5 in a perspective view, a section through the flange plate according to the line V-V in FIG. 4, FIG. 6 a view of a modified embodiment of the slotted flange plate with an adapter ring that can be inserted into this flange plate and that has a break on its side, FIG. 7 in a perspective view, in section through the flange plate according to the section line VII-VII in FIG. 6, wherein the adapter ring and a seal can be recognized, FIG. 8 a perspective, exploded-view of an embodiment of a plug connector according to the invention with a coaxial knurled nut provided on this connector and with a flange plate according to FIGS. 6 and 7 before the joining and before the assembly, and FIG. 9 a view of the assembly position of the plug connector according to FIG. 8, shown as back-plate assembly.
Figure 6:
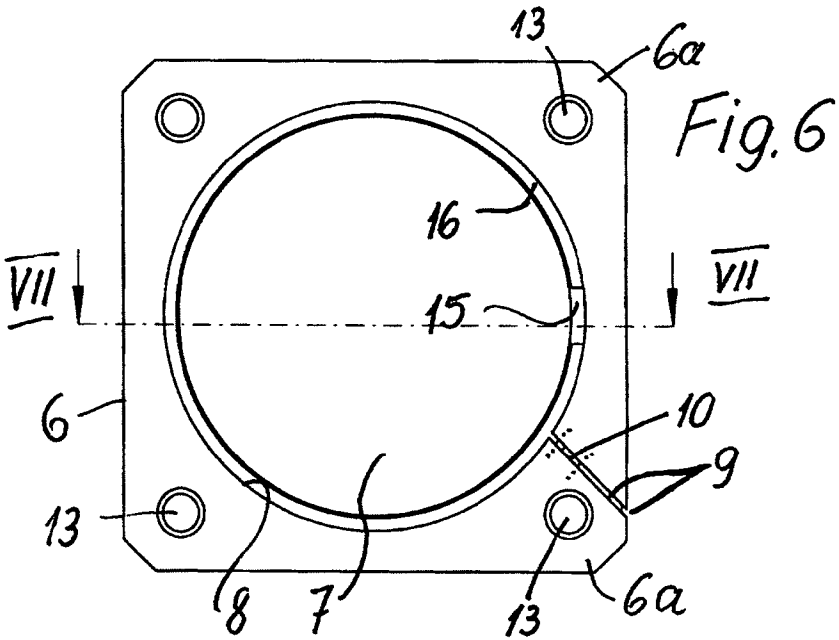
Figure 8:
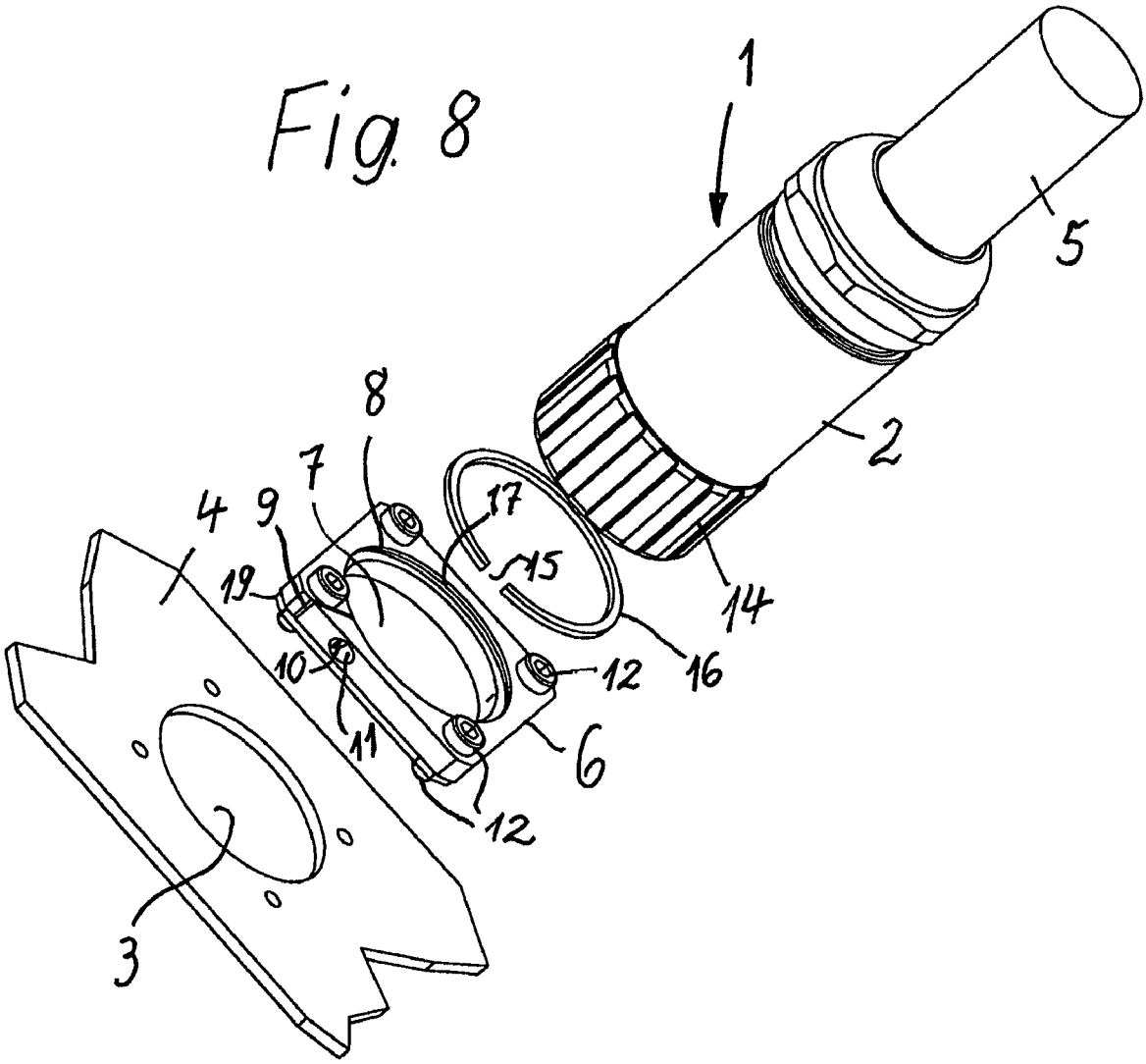

In this embodiment, a square flange is provided as the flange plate 6 whose corner regions 6*a* have openings or perforations 13 arranged parallel to the inner recess 7 for attachment elements or screws 12 that one sees, for example, in FIGS. 1, 8, and 9.

Here, this single slot 9 is arranged in a corner region 6*a* adjacent to an attachment perforation 13 at a position that has a greater radial dimension than the middle between two corner regions 6*a* of the flange plate 6, so that the slot 9 has the greatest possible length with sufficient space for a sufficiently thick clamping screw 10. For example, in FIG. 4 it can be clearly seen that through this arrangement, on one side, an attachment screw 12 and, on the other side, the clamping screw 10 have sufficient space and do not obstruct each other.

The slot 9 here extends in the radial direction relative to the approximately circular inner recess 7 and to the approximately circular inner periphery 8 of the flange plate 6 and the clamping screw 10 is arranged parallel to a not-shown, imaginary tangent to the inner periphery 8 extending through this slot 9. In this way, the most uniform possible transmission of the clamping force starting from the clamping screw 10 during its tightening is produced onto the inner periphery 8, in order to press the flange plate 6 as uniformly as possible onto the outside of the housing 2 of the plug connector 1.

In the embodiment according to FIGS. 6 to 9 it is provided that the inner recess 7 and its inner periphery 8 exceeds the similarly circular outer contours of the housing 2 of the plug connector 1 by a region of greater diameter, namely a knurled nut 14, located on the plug connector 1 and adjacent to the position of use for the arrangement of the flange plate 6, that is, at least in the pre-assembled position, a greater diameter or cross section than this knurled nut 14, so that the flange plate 6 can be pushed in the axial direction over this knurled nut 14 onto the housing 2 of the plug connector 1.

Figure 7:
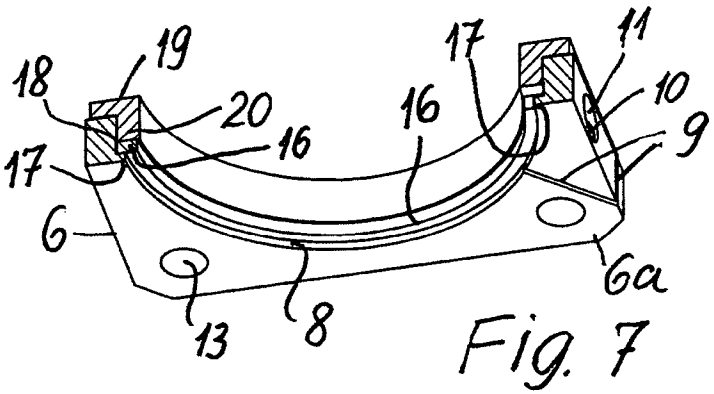
Figure 4:
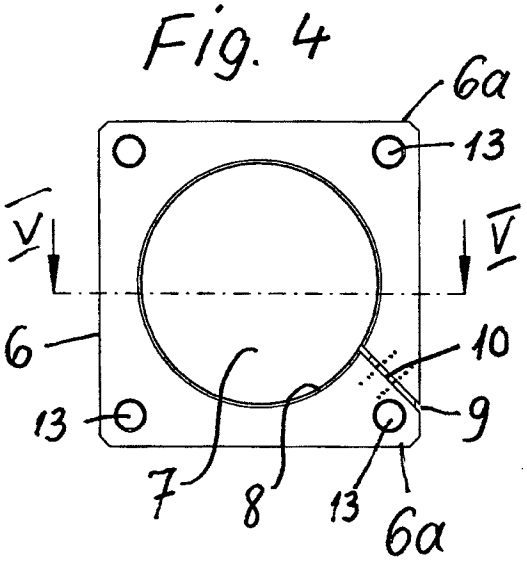

Furthermore, it is provided that the flange plate 6 holds an adapter ring 16, also with a slot 15 or a break, in the position of use in the inner periphery 8 that is formed as an elastic ring and that contacts, in the position of use in the axial direction, on a stop 17 in the inner recess 7 of the flange plate 6, as seen especially clearly in FIG. 7.

Therefore it is possible according to FIG. 8 to shift this adapter ring 16 at first in the axial direction over the knurled nut 14, then to place the flange plate 6 with the relatively large inner recess 7 on top, and then to insert the adapter ring 16 into the inner periphery 8 of the inner recess 7 and to contact the stop 17, so that a relatively small tightening movement of the clamping screw 10 is sufficient to achieve, through the use of the adapter ring 16, a desired clamping effect on the outside of the housing 2 of the plug connector 1. Indeed, the width of the slot 9 could also be shaped large accordingly, but then a considerable reduction of the slot width would have to be performed, which could lead to inaccuracies in the relative position of the slot edges relative to each other and to the inner recess 7. Because a portion of the diameter difference between the inner recess 7 and the housing 2 could be bridged by the adapter ring 16, a relatively small movement for narrowing the slot 9 of the flange plate 6 is also sufficient in the case that the plug connector 1 has a knurled nut 14 for producing the clamp connection between the flange plate 6 and the housing 2 of the plug connector 1.

In parallel to the annular stop 17 arranged on or in the inner opening 8 of the flange plate 6, there is a smaller undercut 18 that can be seen in FIG. 7 and whose distance from the stop 17 is equal to or somewhat greater than the axial thickness of the spring or adapter ring 16, wherein the width of the slot 15 or the break of the unloaded adapter ring 16 is dimensioned so that it fits over the undercut 18 with a reduced slot 15 or with a reduced break and can be inserted in the axial direction up to the stop 17, where it then comes to lie with a positive fit due to its spring-like property behind the undercut 18 and also cannot be lost during transport or storage.

Figure 5:
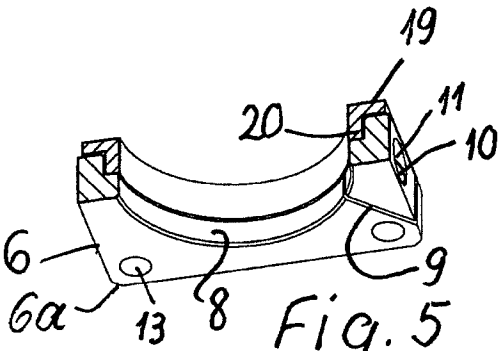

In FIGS. 5 and 7 it is also easy to see how the flange plate 6 can be sealed on one side relative to the plate 4 and on the other side relative to the outside of the housing 2 of the plug connector 1. For sealing the flange plate 6 relative to the housing plate 4 and/or the outside of the housing 2 of the plug connector 1 there is a seal 19 that partially engages in the inner recess 7 and the inner periphery 8 of the flange plate 6 and that has, in the region of the inner recess 7, an axial annular projection 20 or a widened section that fits in the inner recess 7 and covers this at least across a portion of the axial dimension, in the embodiment according to FIG. 7 up to an adapter ring 16 arranged in the inner opening 7. When the attachment screws 12 and the clamping screw 10 are tightened, this seal 19 acting on two different surfaces presses against the positions to be sealed and can fulfill its task.

According to FIGS. 5 and 7, the seal 19 of the flange plate 6 engages in the flange plate with its annular projection 20 in the axial direction approximately up to the middle of the inner recess 7 of the flange plate 6 and also covers its slot 9 and also completely or partially the surface or contact surface of the flange plate 6 extending in the radial direction to this slot, so that the seal 19 is also located between the flange plate 6 and the plate 4.

The plug connector 1 is arranged in the position of use with its housing 2 in or at an opening 3 in a plate 4 or passes through this plate in front-plate or back-plate assembly and contains wires and/or braids of a cable 5, as well as electrical contacts. The assembly on the plate 4 is realized via a flange plate 6 that can be positioned at a later time on the outside of the housing 2 and has an inner recess 7 with an inner periphery 8 for gripping around the housing 2 of the plug connector 1. Here, the flange plate 6 has a one-part construction and a slot 9 or a break that extends continuously outward from its inner recess 7 and that acts as a clamping slot, because the inner periphery of the inner recess 7 of the flange plate 6 can be reduced through narrowing of this slot 9 or break and means are provided with which the flange plate 6 can be pressed, through a reduction of its inner periphery 8, onto the outside of the housing 2 of the plug connector 1 and thus can be clamped. Preferred means for reducing the slot 9 are at least one clamping screw 10 with locking thread or possibly a lock nut.

The invention claimed is:

1. Plug connector (1) comprising a housing (2) that is arranged in a position of use in or at an opening (3) in a plate (4) or passes through the opening and contains wires or braids of a cable (5) and electrical contacts, the plug connector (1) is mountable in a front-plate assembly or in a back-plate assembly, in a region of the opening (3) of the plate (4) by a flange (6), and the flange (6) is formed as a flange plate that is positionable at a later time on an outside of the housing (2) of the plug connector (1), and includes an inner recess (7) with an inner periphery (8) for gripping around the housing (2) of the plug connector (1), the flange plate (6) has a one-part construction and a slot (9) or a break extends continuously outward from the inner recess (7), the inner periphery (8) of the inner recess (7) of the flange plate (6) can be reduced by narrowing the slot (9) or the break, and clamping element is provided with which the flange plate (6) can be mounted through reduction of the inner periphery (8) to an outside of the housing (2) of the plug connector (1), and the flange plate (6) comprises a polygonal flange or square flange having corner regions (6*a*) with openings or perforations arranged parallel to the inner recess (7) for attachment elements or screws (12) and the slot (9) or the break is arranged in a corner region (6*a*) without an attachment perforation or adjacent to an attachment perforation (13) at a position that has a greater radial dimension than a middle between two corner regions (6*a*) of the flange plate (6).

2. Plug connector according to claim 1, wherein the flange plate (6) attaches with a non-positive fit to and is mounted detachably on the outside of the housing (2) of the plug connector (1) in the position of use.

3. Device according to claim 1, wherein the slot (9) extends in a radial direction relative to the approximately circular inner recess (7) which is approximately circular or to the inner periphery (8) of the flange plate (6) which is approximately circular and the clamping screw (10) is arranged parallel to a tangent to the inner periphery (8) and extends through the slot (9).

4. Device according to claim 1, wherein the inner recess (7) exceeds the outer contours of the housing (2) of the plug connector (1) in a region of greater diameter located on the plug connector (1) and adjacent to the position of use and holds an adapter ring (16) similarly having a slot (15) or a break in a position of use in the inner periphery (8), wherein the adapter ring is formed as an elastic ring and contacts, in the position of use, in an axial direction at least one stop (17) in the inner recess (7) of the flange plate (6).

5. Plug connector according to claim 1, wherein for changing a width or dimension of the slot (9) or the break, the clamping element comprises at least one adjustment or clamping screw (10) that is oriented transverse or perpendicular to a profile of the slot (9) or the break and that is arranged adjustable outside of the inner periphery (8) and outside of the inner recess (7) having the inner periphery (8) in the flange plate (6).

6. Device according to claim 5, wherein the clamping screw (10) is arranged on one side of the slot (9) in a recess (11) oriented approximately in a peripheral direction of the inner periphery (8) and passes through or bridges the slot (9) and engages in a mating thread on the other side of the slot (9).

7. Plug connector according to claim 1, wherein for sealing the flange plate (6) relative to the housing plate (4) or an outside of the housing (2) of the plug connector (1) there is a seal (19) that engages at least partially in the inner recess (7) and the inner periphery (8) of the flange plate (6) and that has, in a region of the inner recess (7), an axial annular projection (20) or a widened section that fits in the inner recess (7) or covers this at least across a portion of the axial dimension or up to an adapter ring arranged in the inner recess opening (7).

8. Plug connector according to claim 7, wherein the seal (19) of the flange plate (6) engages in the flange plate in the axial direction at least approximately up to a center of the inner recess (7) of the flange plate (6) and at least partially or completely covers the slot (9) or break and the surface or contact surface of the flange plate (6) extending in the radial direction to the slot or break.

9. Plug connector (1) comprising a housing (2) that is arranged in a position of use in or at an opening (3) in a plate (4) or passes through the opening and contains wires or braids of a cable (5) and electrical contacts, the plug connector (1) is mountable in a front-plate assembly or in a back-plate assembly, in a region of the opening (3) of the plate (4) by a flange (6), and the flange (6) is formed as a flange plate that is positionable at a later time on an outside of the housing (2) of the plug connector (1), and includes an inner recess (7) with an inner periphery (8) for gripping around the housing (2) of the plug connector (1), the flange plate (6) has a one-part construction and a slot (9) or a break extends continuously outward from the inner recess (7), the inner periphery (8) of the inner recess (7) of the flange plate (6) can be reduced by narrowing the slot (9) or the break, and clamping element is provided with which the flange plate (6) can be mounted through reduction of the inner periphery (8) to an outside of the housing (2) of the plug connector (1), the inner recess (7) exceeds the outer contours of the housing (2) of the plug connector (1) in a region of greater diameter located on the plug connector (1) and adjacent to the position of use and holds an adapter ring (16) similarly having a slot (15) or a break in a position of use in the inner periphery (8), wherein the adapter ring is formed as an elastic ring and contacts, in the position of use, in an axial direction at least one stop (17) in the inner recess (7) of the flange plate (6), and undercut (18) is provided whose distance from the stop (17) is equal to or greater than an axial thickness of the adapter ring (16), the undercut is arranged parallel to the stop (17) arranged on or in the inner opening of the flange plate, and a width of the slot (15) or break of the unloaded adapter ring (16) is dimensioned so that it fits with a reduced slot (15) or with a reduced break over the undercut (18) and can be inserted in the axial direction up to the stop (17).

* * * * *